United States Patent [19]

Oswald et al.

[11] 3,946,312

[45] Mar. 23, 1976

[54] TIMING APPARATUS AND SYSTEM

[76] Inventors: Robert A. Oswald; Charles R. Kilet, both of P.O. Box 458, Highway 395 South, Gardnerville, Nev. 89410

[22] Filed: June 25, 1974

[21] Appl. No.: 483,080

[52] U.S. Cl. ..... 324/181; 235/92 TA; 272/4; 273/86 R; 343/225; 272/5

[51] Int. Cl.[2] ..... G04F 8/00

[58] Field of Search ..... 324/178, 179, 181; 340/323, 23, 408; 235/92 TA, 92 GA; 273/86 R, 54 R; 343/200, 225, 6.5; 272/4, 5

[56] References Cited

UNITED STATES PATENTS 3,795,907 3/1974 Edwards ..... 235/92 TA

*Primary Examiner*—R. V. Rolinec
*Assistant Examiner*—Michael J, Tokar
*Attorney, Agent, or Firm*—Donald J. De Geller

[57] ABSTRACT

A system and method by which antenna type loops are situated at predetermined positions about a race track in which a plurality of contestants are passed sequentially over the loops while carrying a transmitter arranged to transmit a low radio frequency signal of a frequency discreet for each contestant and in which a series of timers controlled by a single clock are arranged in reference to each contestant so that at the start of the race all of the timers are made to start to operate in timed unison and whereby the several timers associated with each contestant are sequentially stopped upon the signal from the transmitter emanating from each contestant being sequentially received at the succession of loop antennas to indicate the lapsed time from the start of the race to each station incorporating an active loop.

13 Claims, 13 Drawing Figures

TIMING APPARATUS AND SYSTEM

In horse racing and other similar types of events it is desirable to provide means for indicating the precise time required for each horse at predetermined positions along the track. In the present invention means are provided at predetermined positions along the track to generate signals which are then employed to register the precise lapsed time from the start to each of said predetermined positions. This is accomplished by mounting a small low radio frequency transmitter on each contestant and providing at each desired station on the track a loop which can be buried under the surface of the track in such a way that when the transmitter on the contestant passes a section of the loop, a signal is generated to a counter and display unit. The counter starts counting at the beginning of the race and is arranged to stop one counter display of a series upon being energized by a signal, generated by the contestant-carried transmitter, received at a loop and additional displays of the series are thereafter stopped upon being energized by the signals received at additional loops or stations along the track.

In the present invention antenna loops are mounted at a plurality of discreet positions preferably under the surface of the track and are connected for switching into a single transmission line to the timing counter system. By this means selective ones of the several loops during any one race can be connected into the system with other selected ones of the antennas being deactivated from the system.

This is an important feature wherein in certain types of race track uses, such as in horse racing, it is desirable to measure the timing at different locations along the track in accordance with the requirements of the type of race that is being run. For example, it might be ideal to have the timing broken down into quarters of a mile. However, when the race starts at different positions on the track the quarter mile positions would be out of phase with the position of the antenna. In this case, ideally, the loops can be located, for example, at every sixteenth of a mile and thereafter for any particular race those loops which are in one quarter mile phase relation to the start position of the race are connected to the common line while the others are switched out of the system and are completely non-functionally dormant.

It is the object of this device, therefore, to provide a flexibility wherein it is convenient to change from race to race the various positions at which timing information is to be generated.

It is a further object of this invention to provide a discreet transmitter unit for each contestant which has been constructed in a size and configuration adaptable for being placed in a position coincident with the conventional numbers carried by the contestant. For example, in horse racing on the head or the ear section of the horse there is a numbered card for visual identification of the horse during the race. The transmitter is thus arranged in a size in which in the more ideal form the discreet number can be placed on a pocket in which the transmitter is carried so that the pocket provides both the visual numerical reference for the horse or other contestant as well as providing a mounting for the transmitter.

Another feature and advantage of this invention includes within the transmitting card previously referred to an inductance and antenna configuration which is both desirable and diminutive to accomplish the required radiation characteristics.

It is a further object of this invention to provide a transmitting circuit which is arranged to transmit a narrow band low frequency signal of a fixed predetermined frequency which is modulated by a second audio range frequency to provide a transmitting output which can be selectively received by the timing unit in which the frequency spacing between respective transmissions is such that the receiving station can not only discriminate between selective transmitters but via the audio modulation is capable of discriminating against spurious noise and other undesirable signals which might be received by the loops. By this means discrimination against signals generated by natural or man-made signal generation can be eliminated.

A further feature of this invention resides in the use of a plurality of timing displays associated with each contestant in which each of the displays is actuated by a clock in such a way that the lapsed time from a start is simultaneously indicated on each of the displays. A disabling circuit is arranged to sequentially stop each of the displays in order of the contestant passing each of the selected antennas. By this means the displays during, and at the termination of the race, will be frozen at the precise lapsed time, referenced to the start of the race, to the station associated with the specific display.

In the present invention each of the selected displays in association with each contestant is arranged to be activated through signals received by a receiver processing unit in which the signal received is highly selective and discriminating with respect to frequency whereby only signals of the frequency generated by a selected card is capable of activating the specific receiving unit. The processing unit is then further arranged to discriminate the audio signal so that only signals of the appropriate signal and the appropriate modulation can pass through the receiver to deactivate the respective displays.

It is another feature of the display device to provide each display in sequence with means for allowing only one display to stop at the lapsed time interval for the signal received at each loop and upon stopping to thereby arm a subsequent display to enable the subsequent display to stop when the signal is received due to the transmitter passing the next loop within the racing circuit.

Another feature and advantage of this invention lies in the fact that all of the functions occurring in the displays are electrical and capable of being connected for recording on conventional recording apparatus for later input into computers or other information storage or retrieval devices.

As previously discussed the timing apparatus has been associated in situations in which the race starts from a fixed start as in the case where the start of the race occurs when the gate is opened. In such a case each of the timing displays for each of the contestants is arranged to stop with reference to the start time i.e. when the start gate opens. However, in certain application such as in thoroughbred horse racing the timing necessary is somewhat different.

In thoroughbred racing the horses start at the gate but the timing occurs from a point in time when the first horse passes a given reference start line. In such a case the present invention incorporates circuitry whereby only the first row of displays associated with each contestant is arranged to start counting at the time the start gate is opened. Thereafter the remaining stations of displays are restrained from starting to register counts from the clock until the first of the several contestants passes a designated start line. At such time all of the remaining counter displays are latched to a counting condition. By virtue of this feature the device of the subject invention can be used for conventional starting procedures as well as for the flying or running starts associated with such racing events as thoroughbred racing.

One of the features and advantages of the present method and apparatus is the adaptability of the device to be displayed by a singular display panel on which a numerical display indicating lapsed time can be arranged in rows and columns in which the horizontal rows are associated with each contestant and the vertical columns are associated with each station along the track. In this display the rows are successively stopped at the appropriate lapsed time for each contestant so that the number remains in a displayed unit throughout and after the termination of the race thus allowing for semi-permanent retention of the lapsed time for each contestant at each of the racing stations. Permanent recording by simply photography of the panels is, therefore, feasible.

In a further embodiment of the present invention there is a provision for means whereby the relative position or sequence of each contestant passing a given station can be registered so that instantly it can be discerned which contestant is first, second, third etc. at a given station.

While the discussions and reference are more directed to horse racing than to other racing events it is believed obvious that the method and means of the present invention can be applied to other types of time measuring situations, either within contestant racing environments or in other situations where the lapsed time of multiple entities from a fixed point need to be monitored and recorded. The system in its entirety thus incorporates the flexibility of selecting from a multiple of predetermined locations at which lapsed time is to be determined, with the further provision of allowing the flexibility of using either conventional timing from a given start or the lapsed time start configuration associated with a flying or running start as when the race starts when the first contestant passes a predetermined start line.

DETAILED DESCRIPTION OF THE DRAWINGS

Figure 7:
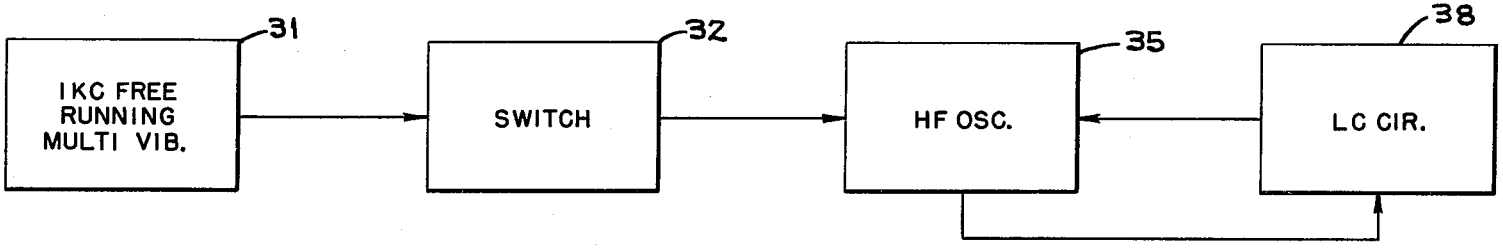
FIG. 7 is a block diagram of the transmitting circuit.
Figure 8:
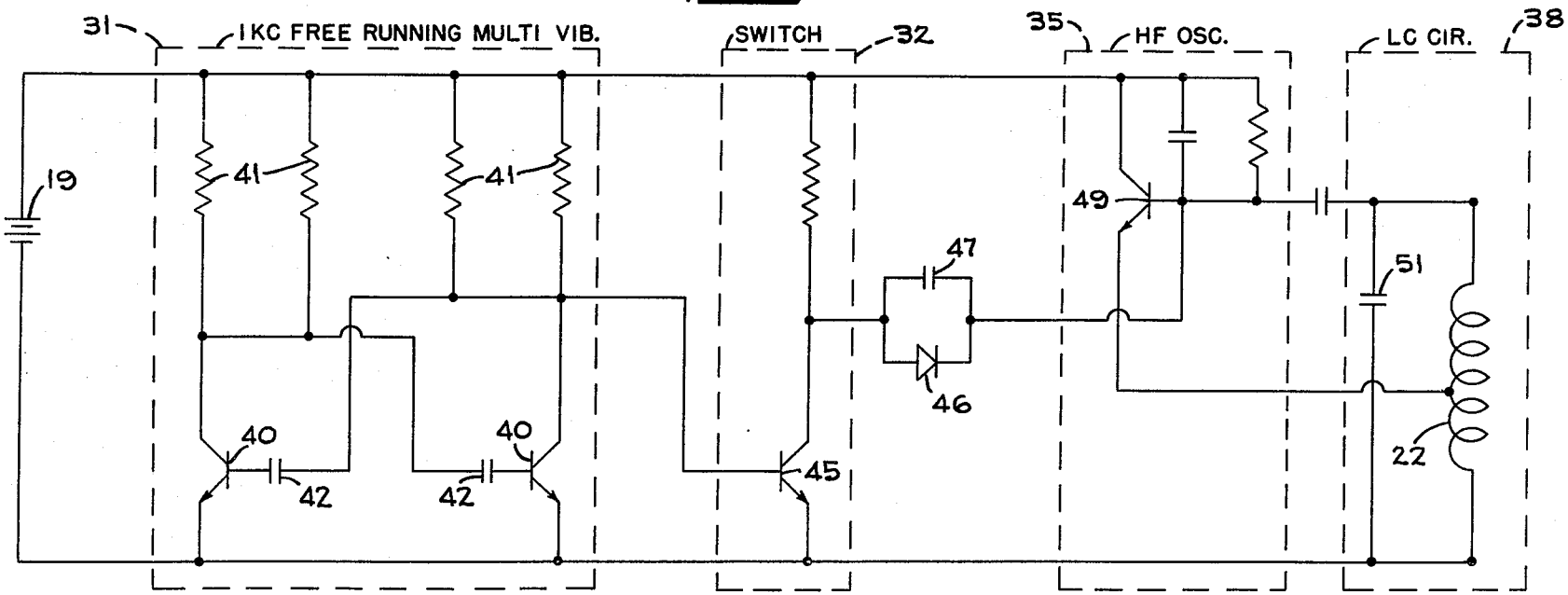
FIG. 8 Is a schematic view of the circuits contained within the block diagram of FIG. 7.
Figure 9:
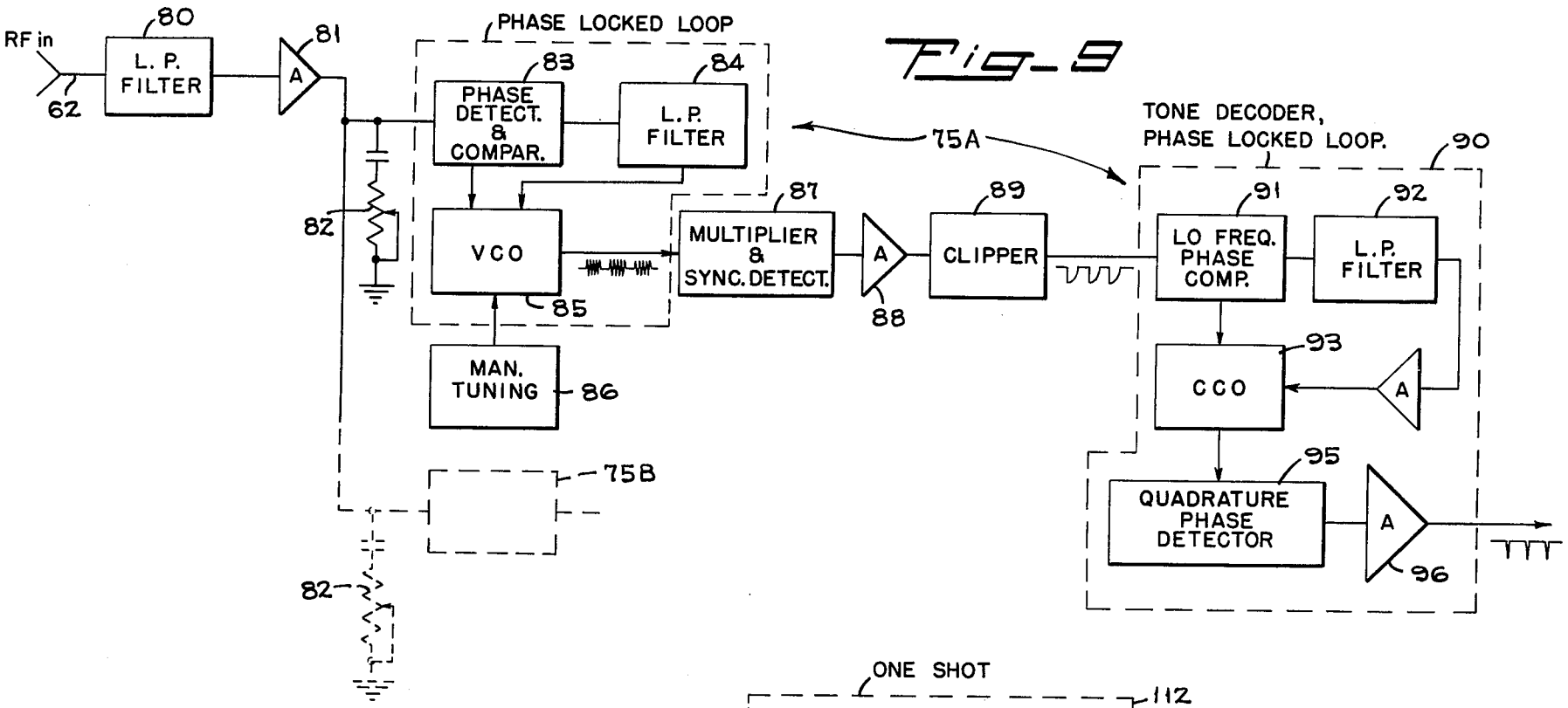
FIG. 9 is a block diagram of the receivers.

The transmitter for mounting on the contestant encompasses a card 18 upon which a battery 19 and appropriate electrical elements 21 are mounted in conjunction with a printed spiral loop 22 which provides the inductance and the radiating element for the transmitter. Card 18 is mounted in a pocket 23 on the forehead 25 between the eyes of a contestant such as horse 28. The pocket on its outer face is provided with a number such 1, 2, 3, etc., which can be a specific identifying number for the particular horse or other contestant. Thus pocket 23 provides the visual contestant identifier as well as a holding pocket for transmitting card 18. The electrical circuit elements 21 as shown in FIG. 7 and 8 include a 1 KC free running multivibrator 31 which activates an electrical switch or gate 32 to provide a square wave output to a high frequency oscillator 35 in which the LC circuit 38 is incorporated within the oscillator circuit. The multivibrator 31 is of conventional design incorporating a pair of transistors 40 with appropriate resistors 41 and capacitors 42 selected to cause a multivibrator to run free at 1,000 cycles or some other preselected frequency within the audio range. The output from multivibrator 31 is applied to the base of transistor 45 of the switch 32 to provide a square wave output through diode 46 and capacitor 47 to the base of transistor 49 of the high frequency oscillator to cause the oscillator to turn off and on at the frequency rate of the switch 32, i.e. 1,000 cycles.

The oscillator is regulated to oscillate at a frequency determined by the inductance of loop 22 and capacitor 51 which forms the tank circuit for the oscillator As previously described loop 22 is printed on card 18 and ideally is of a fixed predetermined inductance and configuration for all cards, thus for practical considerations the determinative frequency control element is capacitor 51. Thus the card for each contestant would have a selected value for capacitor 51 so that the frequency output for the high frequency oscillator 35 would be of a discreet different frequency for each card to thereby identify, by frequency, each contestant. It can be seen that the output from the transmitter on card 18 would identify the particular contestant.

Figure 3:
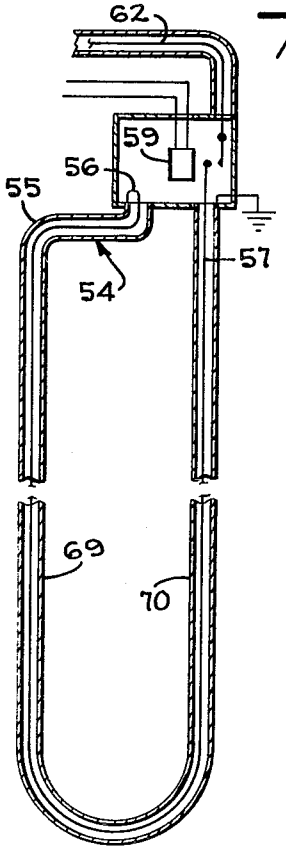
FIG. 3. is a detailed schematic of the receiving loops.

It has been found that the system is most satisfactory in the lower RF frequency range, that is in the area below 350 KH, with the spacing between transmitter frequencies being approximately 10 KH, although closer or greater spacing can be used within the framework of the subject invention. For example, it has been found that a good identification and discrimination between contestants can be had with 5 KH spacing or separation. Loops 54 constitute a cable having the outer shield 55 connected at one end 56 to the inner conductor 57 and at the other end the outer shield 55 is connected to ground with the inner conductor 57 being connected to switch 59 for connection of the inner conductor to a common coaxial distribution line 62 as shown in FIG. 3.

Figure 2:
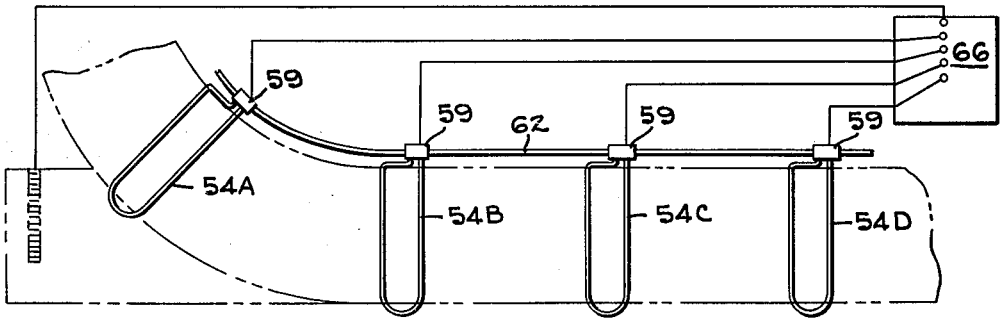
FIG. 2 shows a portion of a race track with receiving loops shown in position with respect to the track.
Figure 4:
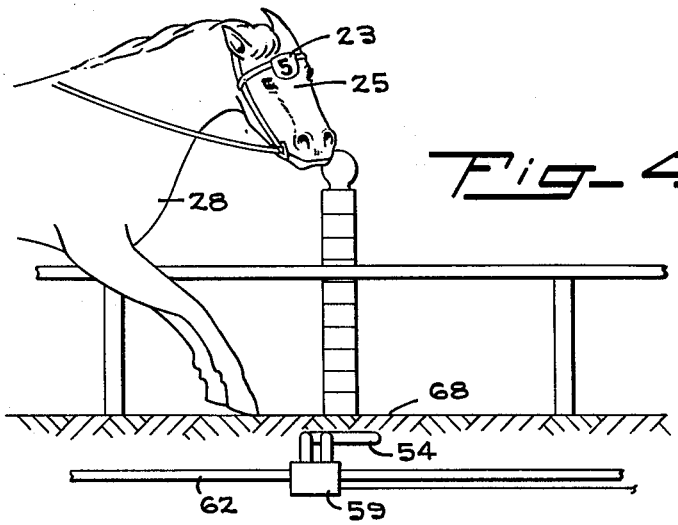
FIG. 4 is a cross sectional view of a track showing the loop position under the surface of the track.
Figure 5:
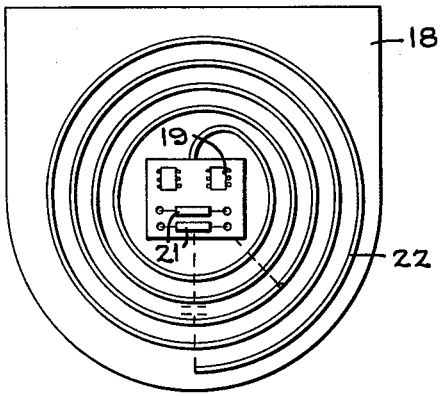
FIG. 5 is a plan view of a transmitting card.

This loop system acts as a closed circuit untuned transformer presenting a 90° phase relation between voltage and current induced in the system passing over the loop. The switch 59 is relay activated by appropriate switching (not shown) connected to console 65 and as illustrated by the various control buttons 66. Thus by actuating the various buttons 66 selected ones of antenna loops illustrated at 54A, 54B, 54C and 54D et seq. of FIG. 2 can be included or excluded from the activating circuit. Each of the antennas or loops 54A – D is connected to the common line 62 when its appropriate relay switch 59 is actuated by the appropriate positioning of switches 66. As previously stated, thus any one of the loops may be connected or disconnected from the line at will and as also previously stated the number of loops that may be permanently installed around the track is limited only by the intended need for stations to be utilized within the racing system.

Coaxial loops are mounted underground immediately below the surface 68 of the race track so that it can be completely concealed from and provides no impediment to the racing contestants. It is also within the scope of practicality of this device to have the loops mounted above or around the sensing station, however, for aesthetic and practical purposes the mounting under the ground has obvious advantages.

The loop should transverse the entire width of the active section of the track and the exit length 69 and return segment 70 can conveniently be spaced approximately one foot apart. As previously described, the transmitter card 18 is mounted on the forehead of the contestant 25. In this position the radiating face of coil 22 is arranged to be oriented at an angle which is best suited for radiation transferance from inductance 22 to the legs of loop 55. It is best suited to position the card at this angle for most efficient transmission although the device will work with somewhat lesser efficiency if mounted on the ear or side of the head of the horse, for example.

Figure 6:
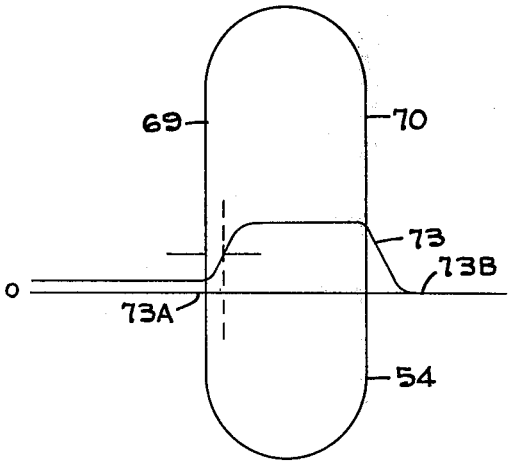
FIG. 6 is a schematic showing the configuration of the loop and an overlay indicating the signal intensity of signals received by the loop.

As shown in FIG. 6 the underground loop 54 is schematically illustrated by an oval. The signal generated into coaxial cable 62 is illustrated by graph line 73, in which it can be seen that as the transmitter card 18 enters the vertical space immediately above the loop 54 there is a virtual zero or negligible signal input into coaxial cable 62, however, immediately after passing the threshold there is an extremely sharp increase in reception or input into loop 54 which continues in intensity until card 18 has passed over the vertical alignment of the exit leg of loop 54 and thereafter there is a sharp attenuation of the signal action as seen in FIG. 6. Thus it can be seen that the signal generated in the common coaxial line 62 has a square wave which exists immediately upon the card passing over the vertical of the entry leg of the loop and terminates immediately after leaving the vertical area above the exit leg of the loop.

Figure 10:
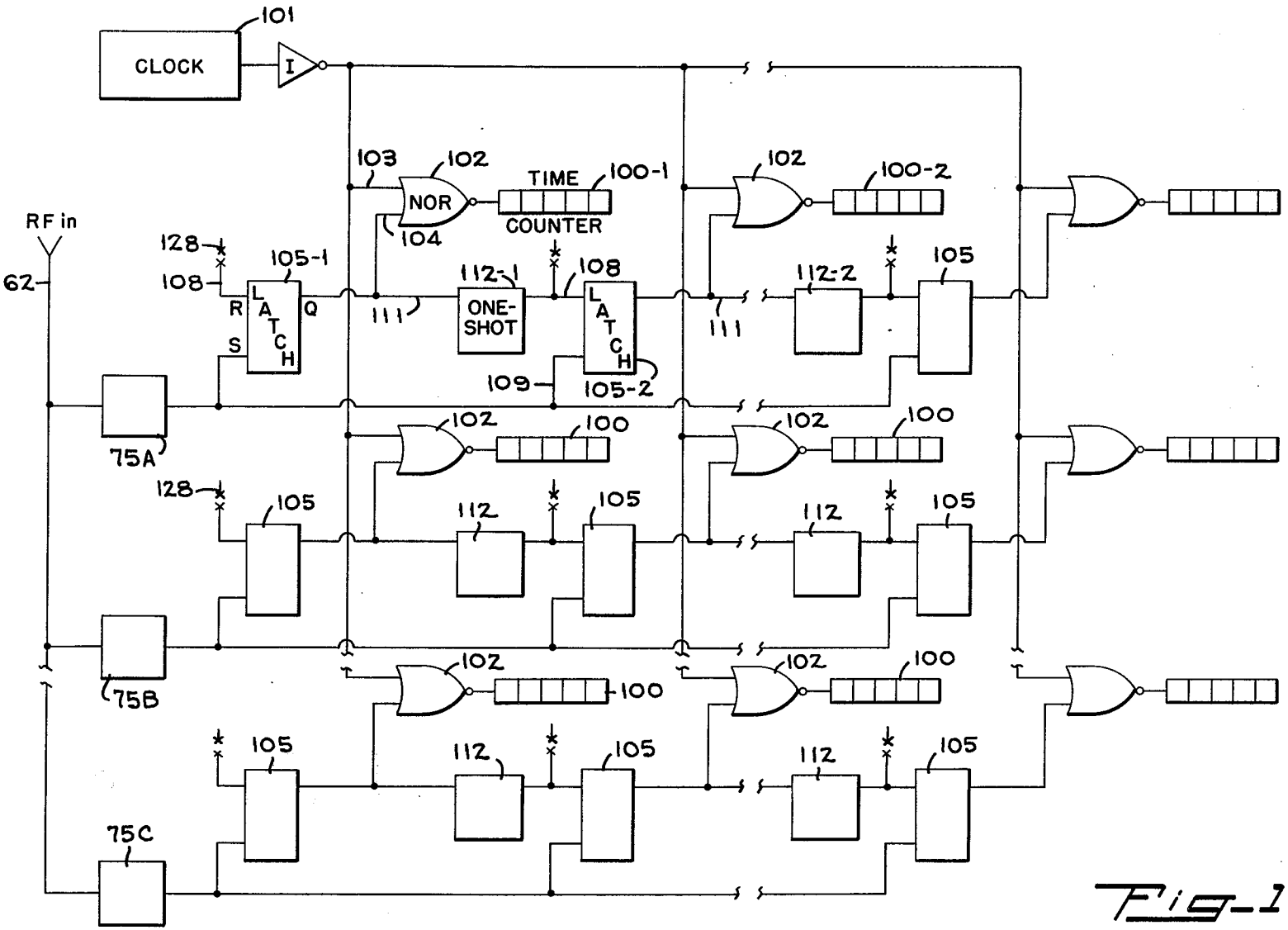
FIG. 10 is a block diagram of the registry and display circuit.

Referring to FIG. 10 the coaxial cable 62 is connected directly to a plurality of receivers 75. Each of said receivers 75 and identified as 75A, B and C, are arranged and tuned to a frequency compatible with the RF frequency output of a particular transmitting card 18. Thus, for example, receiver 75A could be arranged to receive 360 KH in association with a card having its capacitor 51 arranged to provide a 360 KH output. Wherein receiver 75B might be tuned to receive a frequency of 370 KH for use in conjunction only with a card 18 having its capacitor 51 selected to provide an output of 370 KH. In series with line 62 is a high frequency filter 80 and an amplifier 81. The high frequency filter 80 is of conventional design and arranged to attenuate all RF energy above the frequency range in which the system is designed to operate. Thus, for example, when the system is arranged to operate in or about the 350 KH range, high frequency filter 80 is arranged to attentuate all RF energy above 350 KH. Thus by operating in the low frequency range and attenuating all above the 350 KH limit much spurious manmade and natural radiation can be eliminated. The output from amplifier 81 is thus fed to the respective receivers 75. It is desirable to include a controlled attenuator 82 to reduce the signal level for each receiver so that compensation can be made for the loops having differing sensitivities. By means of the attenuator 82 the signal level to each of the receivers can be identical.

Each of the receivers 75 employs a phase locked loop detection system which is necessary to discriminate the frequencies outside of the specific frequency for which the receiver is programmed for utilization. Such a phase locked loop system is common in the art and as shown in, "Signetis Linear" Volume 1 Data Book on pages 199 through 224, incorporates a phase detector and comparator 83, a filter 84 and a variable frequency oscillator 85 in which the tuning of the oscillator to the specific utilized frequency is by a manual adjustment at 86. In this system only, signals which have a frequency sufficiently identical to the variable frequency oscillator to maintain a phase locked loop can create an output from the system. Thus by this means of discrimination the signal identification of only the selected frequency is obtainable. The signal is then put through a multiplier synchronization detector 87 and when received is then amplified by an amplifier 88 and clipped by a clipper 89 to provide an essentially square wave output, which would be a square wave of the modulating frequency of the free running oscillator 31 on the transmitter card 18. A tone decoder phase locked loop decoder 90 is thus arranged to discriminate against all signals other than those of the predetermined selected audio frequency selected such as the 1,000 cycle modulation previously referred to. Such a phase locked circuit is similar to the phase locked circuit used in the RF section previously described and is described in, "Signetis Linear" Volume 1 Data Book under tone detector phase locked loop pages 229 through 238, and includes a low frequency phase comparator 91 and filter 92 and a crystal controlled oscillator 93.

The crystal controlled oscillator 93 is tuned for each of the receivers 75A, B etc., and can be of the identical frequency, however, it is believed obvious that in some applications where further discrimination between contestants may be desirable, separate audio frequencies for each contestant may be utilized. The output from crystal controlled oscillator is then detected by a quadrature phase detector 95 which is amplified at 96 to provide a pulse output for use in the counting and display system as will hereinafter be described. In the receiver system it can be seen that via the filter 80 all signals above the working range of the system are attenuated. The high discrimination of the phase locked RF system rejects all signals other than those within the exact range of the desired frequency and then only those signals which are modulated by the appropriate audio frequency may then be utilized. By this means the authenticity of the signal to the timer is insured.

The counter displays with reference to FIG. 10 include numerical readouts 100 which are arranged to a digital output in minutes, seconds, tenths, and smaller time designations if desired. All of the display or register 100 throughout is driven by a single clock 101. Thus when the register is set at zero and is connected to clock 101 each of the registers will in perfect synchronization register and display the lapsed time as controlled and driven by clock 101.

Figure 11:
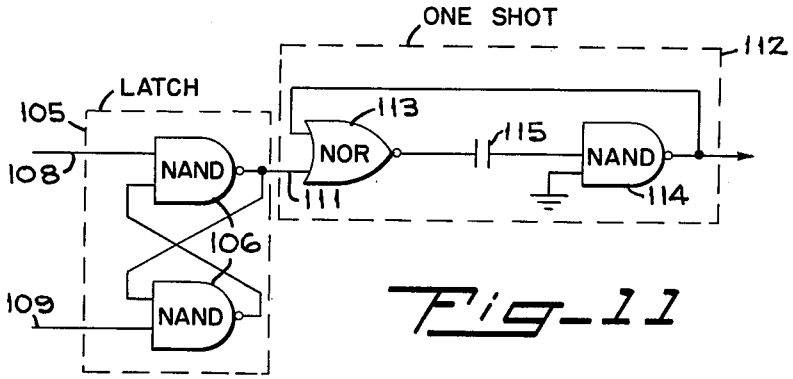
FIG. 11 is a schematic showing the latch and one shot multivibrators used in conjunction with the circuit of FIG. 10.

The essential purpose of the circuits in FIG. 10 is to connect and disconnect the clock 101 from the respective display and register 100 in accordance with the signal input from the respective receivers 75. In order to accomplish this function each of the registers or displays 100 is connected to clock 101 through a NOR gate 102 with one leg or input 103 of each NOR gate being directly connected to clock 101 thus the presence or absence of a signal on the opposite leg 104 of NOR gate 102 will connect the register into and out of the clock circuit. The control leg 104 of each NOR gate is driven, as seen more specifically in FIG. 11, by a latch 105. Latch 105 is simply a bystable multivibrator comprising two cross-connected NAND gates 106 so that in a first condition of operation the latch is arranged to provide an actuating signal for NOR gate 102 to cause the gate to conduct a signal from clock 103 through gate 102 to activate register 100. To start the actuating of register 100 a reset input 108 for latch 105 is activated thus causing latch 105 to go into an operative condition for connecting, via NOR gate 102, clock 101 with register 100. When the signal is applied to the opposite leg 109, latch 105 immediately changes condition thus disconnecting register 100 from clock 101 and thereby freezing the indication of register 100 to the numerical representation at that instant accumulated.

The signal for the input 109 to latch 105 is derived from receiver 75, thus when the receiver senses a signal from a transmitter card, the receiver output causes all of the latches 105 associated with a particular contestant to change condition, this causing the register 100 associated with the latch to freeze at the lapsed time designation then in existence. It can thus be seen that upon the receipt of a signal from receiver 75 momentarily all of the latches 105 in the series association for a particular contestant would be in the "off" condition. However, the output from each latch 105 is also delivered via line 111 to a one shot multivibrator 112. The one shot multivibrator comprises a conventional circuit including NOR gate 113 and a NAND gate 114 coupled by a capacitor 115 which determines the pulse length for the one shot multi vibrator 112.

When the first latch 105 - 1 is switched, a pulse is registered to the input of the one shot multivibrator 112 to which it is connected and the output of which is applied to the reset line 108 of the subsequent latch 105 - 2. In this manner latch 105 - 2 is switched from an operative position to an inoperative position by the signal from receiver 75 via a pulse on line 109, but is immediately, and at a faster time than the pulse output from clock 101, reset into the "off" position from the output of the one shot multi vibrator 112. In this manner the sequences of registers are serially coupled so that upon the first pulse from receiver 75 the first register 100 - 1 will be turned off, and inasmuch as there is no reset pulse to latch 105 - 1, it will remain in an "off" position.

In this case the latch 105-2 for register 100-2 will be immediately reset thus causing the continuance of counting by register 100-2 and this sequence of events will similarly occur throughout the entire line of subsequent registers. On the second pulse output from receiver 75A there will be no effect, whatsoever, on latch 105-1 because at this time the latch has already been shifted to its opposite or "off" state. Thus no reset pulse can occur from the one shot multivibrator driving the next latch, i.e. 105-2. Therefore, the second set of counters 100-2 will be frozen in the time designation then in existence at the time of the second pulse from receiver 75A. It is believed readily apparent that this sequence can be carried out to an infinite number of stations as required.

Figure 1:
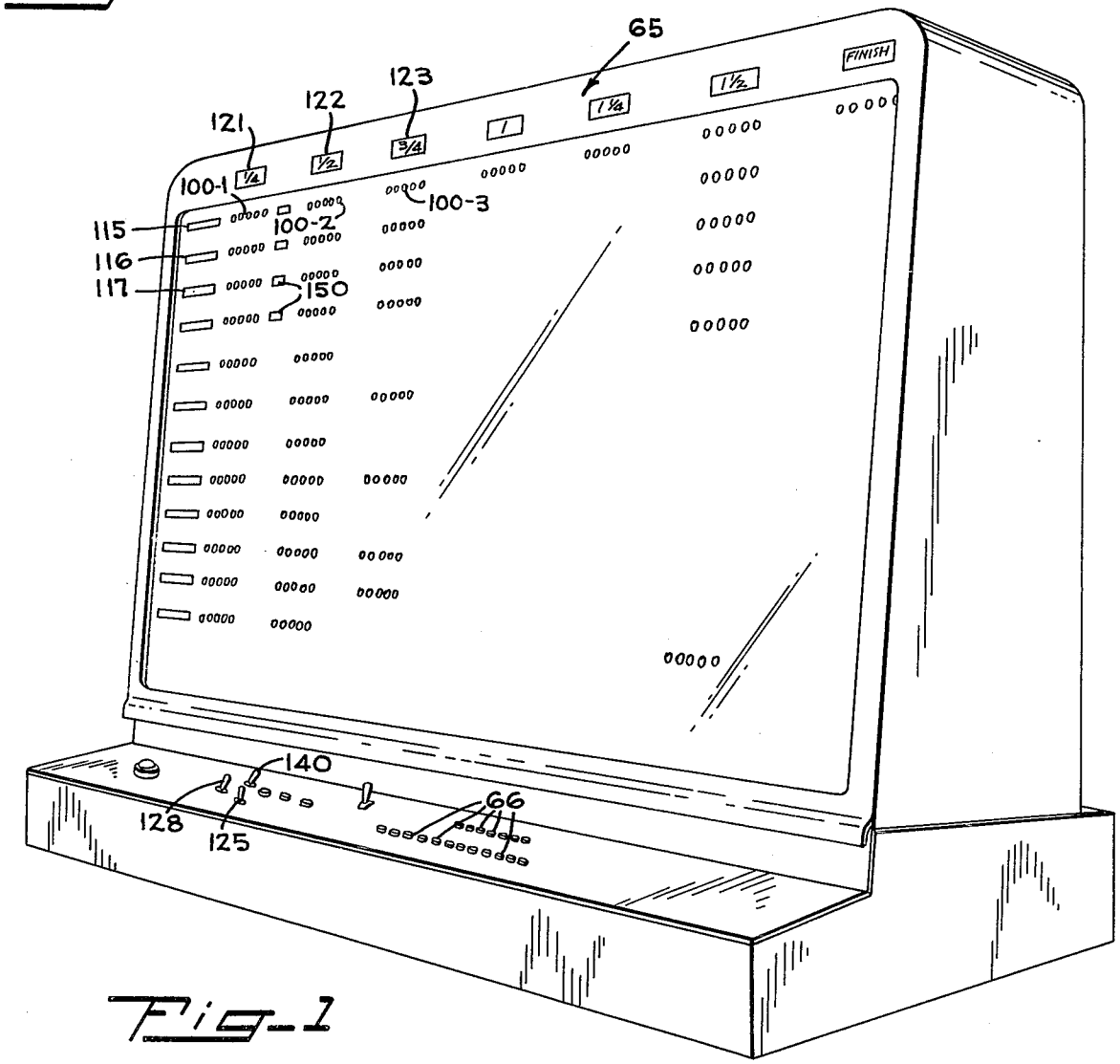
FIG. 1 Is a perspective view of the console for the timing unit showing the time lapsed displays in rows and columns in which the displays of each row indicate a specific contestant and in which the columns are arranged to indicate selective race stations.

In practical configuration, as referred to in FIG. 1, the register 101-1, 101-2, 101-3, are associated with a particular contestant in which, for example, the name of the contestant could appear in either by mechanical, electrical or physical display at windows 115, 116, 117, with each of the windows 115, 116 and 117 indicating a designated contestant and with each of the counters at 101-1, 101-2, 101-3. The selected stations for which the time of penetration by the contestant is coincident, is identified by alignment in columns, above which are windows 121, 122 and 123. These windows, i.e. the station designators, similarly can be electrically, mechanically or otherwise identified or displayed, and may be switched by the loop selector switches 66 to indicate activated loops. Thus the entire board readout of the console 65 will indicate in each row as 115, 116, 117 a sequence of progressive timing for each contestant and the column reference will be the reference for the specific station at which the time is referenced.

In the operation of this device the proper selection by actuation of switches 66 will determine the particular loops 54 that will be tuned into the circuit. Prior to the start of the race a reset button 125 is depressed which leads to conventional circuits (not shown) to resets registers 100 to a zero condition. All of the latches 105 are connected by a single bus to start button 128 which may either be mechanically actuated from the console or actuated by a start mechanism from the track itself, such as by a start signal gate raising mechanism, and the like. When the start bus 128 simultaneously actuates all of the reset legs 108 of all of the latches 105, the entire bank of registers 100 simultaneously start counting in precise synchronization with clock 101. Thereafter each signal from a receiver 75 will cause the first of the line of counters associated with the receiver to freeze at the instant the receiver is actuated, thus giving an indication of lapsed time to the first loop. Subsequently upon passing each loop in the circuit the next in line counter will be simultaneously frozen. It can be seen at the termination of the event all of the counters will be frozen at a time showing the lapsed time from the instant that the start signal was actuated.

It is most important to note that capacitor 115 with the one shot multivibrator 112 must program the one shot multivibrator to provide a reset pulse which is longer than the projected time for the contestant to pass through the loop, i.e. referring to FIG. 6 the time required would be the time required for the contestant to go from point 73A, which is to point at the entry of loop sensitivity, to point 73B, which is the point of attenuation of receiver loop sensitivity. This should normally be in the neighborhood of a tenth of a second or so. It is apparent that if the pulse were of a shorter duration the resetting of the various latches would not be retained. It is also noted that the pulse from the one shot multivibrator 112 cannot be longer than the anticipated time interval for the contestant to pass from one loop to another. This, however, constitutes no practical problem inasmuch as the time element usually constitutes multiple seconds.

Figure 12:
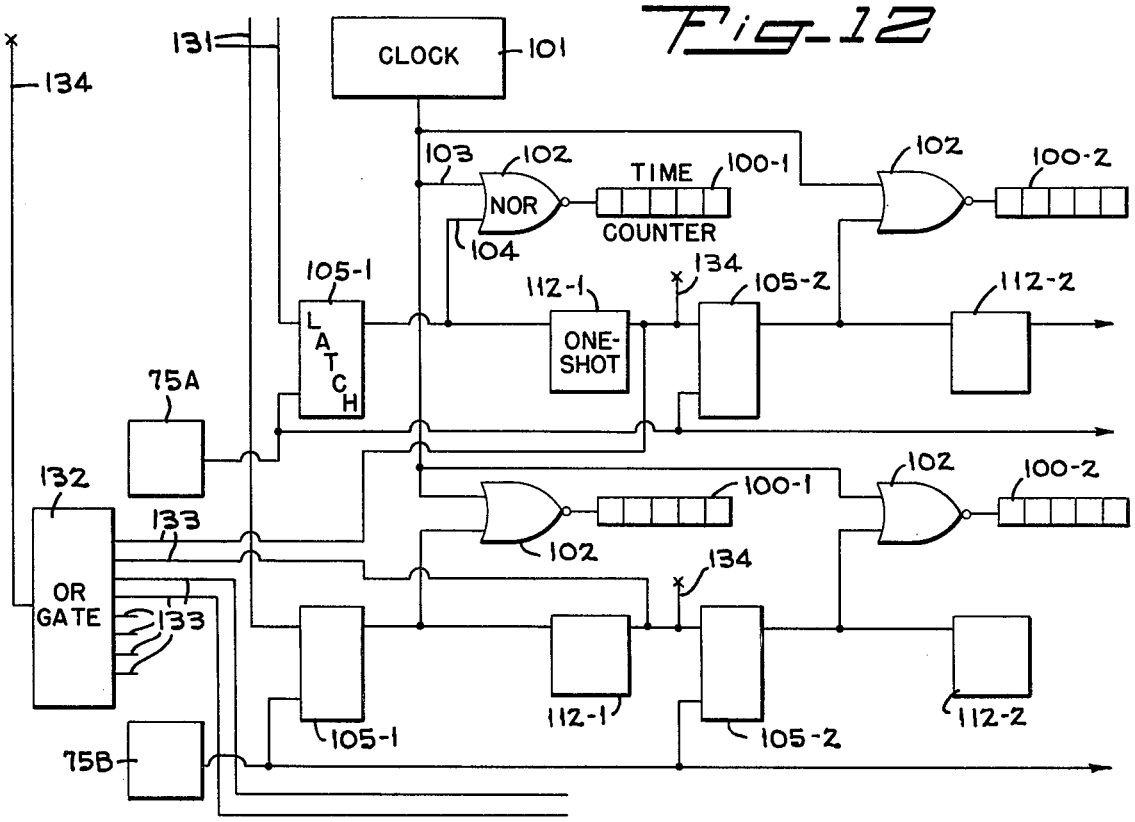
FIG. 12 is a block diagram showing alternative connections for the circuit of FIG. 10 to modify the system for use with thoroughbred or running start type of timing sequences.
Figure 13:
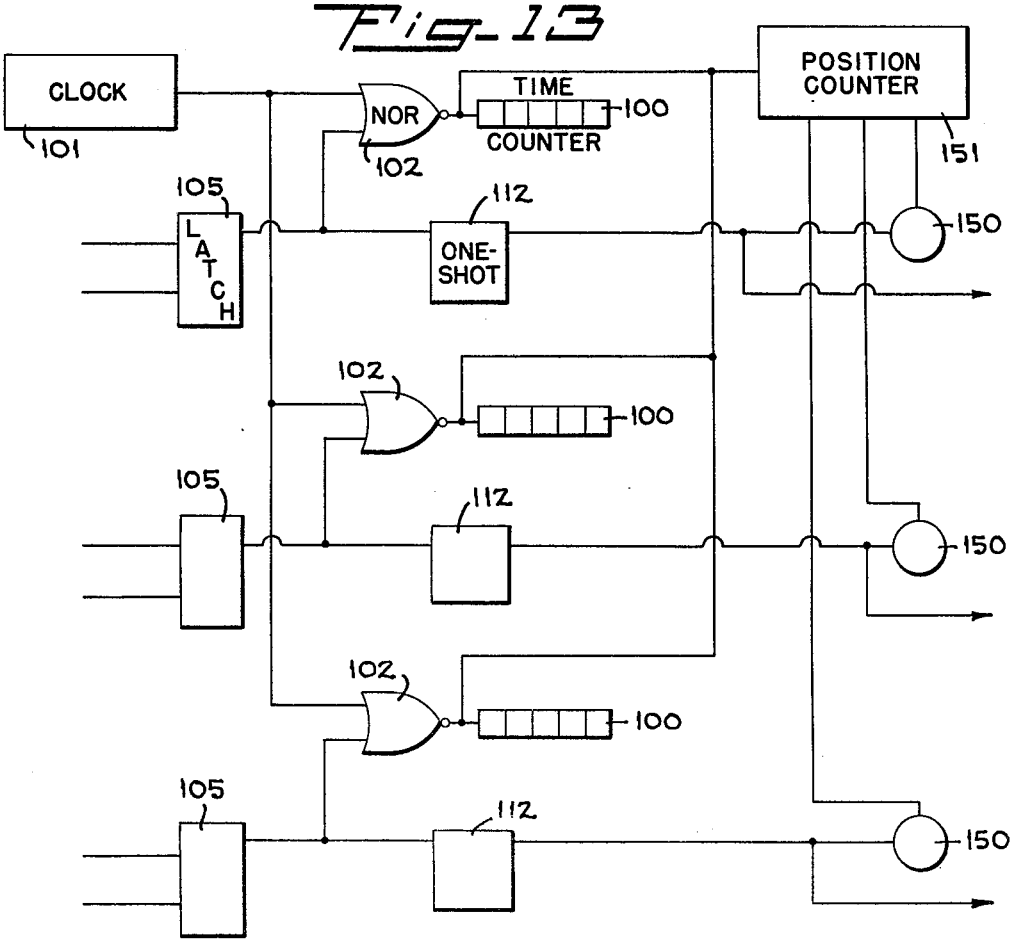
FIG. 13 is a block diagram showing a means for indicating the relative positions of each contestant at a preselected timing station.

In the case of thoroughbred racing and other events in which it is necessary to establish a time from a running start position, the circuit condition as exemplified in FIG. 12 can be implemented. In such a case the start pulse is applied on a line 131 which is connected to the start of only the first line of registers i.e. 100 - 1. The output from the one shot multi vibrators 112 connected with each latch 105 - 1 and designated 112 - 1 is connected to a multiple input OR gate 132 via lines 133 so that upon the input from any line 133, OR gate 132 will provide an output on line 134 which activates the start bus 128 of all of the remaining latches 105 in the system. By this means upon the opening of a gate or the real start of the race a start pulse is applied on line 131. This causes only the first column of counters to count when the first contestant, no matter whom, emits a signal the multi vibrator 112 - 1 associated with that contestant passes a signal through its line 133 to OR gate 132, and consequently a start signal on line 134 to start the timing of all of the remaining timers. This is the theoretical or official start of the race and thus the remaining timers will then show a lapsed time from the official start, while the first row of timers will designate the time from the real start of the race to the position of the contestant to the official start position. This, in practicality, can be accomplished by supplying appropriate switching circuits (not shown) actuated by switch such as shown at 140 on console 65.

It can be desirable to indicate the status of each contestant at each of the selected stations so that, for example, on the console 65 windows indicated at 150, can display the relative orders at which the contestants pass the stations. This can be accomplished for each row by having a status counter 151 which would provide one sequential count each time a counter at that station were stopped via the output from the appropriate one shot multivibrator 112. The display indicating the status number in the counter 151 would then be registered to a display 150 derived from a signal sensing the failure of clock information from clock 101 to the particular register 100. This in turn would cause the status counter numerically from 151 to appear in the window 150 in association with said counter. Whereby a sequential lapsed time indication is registered on each of said counters in reference to the position of said entities with respect to the respective loops.

It is believed apparent that while the drawings and the description apply to a limited number of contestants and stations the circuit, according to the aforesaid teachings, can be extended to any number of contestants and/or stations.

What I claim is:

1. A system for indicating the lapsed time from a start point for each of a plurality of entities to reach a plurality of a succession of predetermined stations along a predetermined path of movement of said entities comprising: radio frequency transmitting means carried by each of said entities, each said means emanating a radio frequency signal discreet for each entity, radio frequency receiving means located at each of said stations and each adapted to receive an interval of signals from said transmitting means when the transmitting means carried by said entity is within a predetermined area of each said station, a plurality of detector means connected to said receiving means, each said detector means being adapted to discriminate and detect signals of a selected one of said discreet radio frequency signals, activating means associated with each of said detector means constructed and arranged to generate an output signal when an interval of signals from the corresponding discreet radio frequency signal is received thereby, a plurality of timing counters serially connected to each of said detector means, clock means operable to operate all said timing counters in timing unison, start means connecting said clock means to said timing counters to start said timing counter means at the same time, a timing counter stopping means for each said timing counter operable by said output signal to cause the said timing counters to discontinue counting upon being actively energized thereby, and sequencing means connected to sequence the active energization by said output signal sequentially to one of the timing counters each time an interval of output signals is received by said receiving means, whereby one of each of said series of counters will stop to indicate lapsed time from said start upon an interval of signals of the discreet radio frequency signal being received at each of the succession of predetermined stations.

2. A system for indicating the lapsed time in accordance with claim 1, and wherein each said radio frequency receiving means comprises a conductive loop having two lengths spaced apart and traversing the path of movement of said entities at substantially right angles thereto, and wherein said loops are buried under the surface of the path of movement of said entities, with said lengths of said loop being in a common planar position relative to the surface of said path.

3. A system for indicating the lapsed time in accordance with claim 1, and wherein each said radio frequency receiving means comprises a conductive loop having two lengths spaced apart and traversing the path of movement of said entities at substantially right angles thereto, and wherein there are provided a greater number of loops than necessary for time station lapsed time measurement for selected events and including means operable to connect and disconnect selected ones of said receiving means loops to said detector means whereby the active predetermined stations along the path of movement of said entities can be varied in accordance with specific timing requirements.

4. A system for indicating the lapsed time in accordance with claim 1, and wherein said radio frequency transmitting means each include a radio frequency oscillator operating at discreetly different frequencies from each other and further providing interrupting means interrupting the oscillation of said transmitter at a frequency in the audio range and wherein each detector means comprises a first circuit selective only to the frequency of a said transmitting means and a second circuit selective to discriminate the detected audio frequency of said radio frequency transmitting means.

5. A system for indicating the lapsed time in accordance with claim 1, and wherein said radio frequency transmitting means each include a radio frequency oscillator operating at discreetly different frequencies from each other and further providing interrupting means interrupting the oscillation of said transmitter at a frequency in the audio range and wherein each detector means comprises a first circuit selective only to the frequency of a said transmitting means and a second circuit selective to discriminate the detected audio frequency of said radio frequency transmitting means, and wherein said first and said detector means each comprise a phase locked loop detector.

6. A system for indicating the lapsed time in accordance with claim 1, and wherein said counter stopping means for each said timing counter includes a gate operable in a first condition to connect said clock to operate said timing counter means, and in a second condition to disconnect said clock therefrom, a bystable latch operable in a first condition to hold said gate in a first condition and operable in a second condition to hold said gate in the second condition and wherein said start means is operable to move said latch from said second condition to said first condition, and wherein said output signal from said detector means is operable to cause said latch to move from the first to the second condition.

7. A system for indicating the lapsed time in accordance with claim 1, and wherein said counter stopping means for each said timing counter includes a gate operable in a first condition to connect said clock to operate said timing counter means, and in a second condition to disconnect said clock therefrom, a bystable latch operable in a first condition to hold said gate in a first condition and operable in a second condition to hold said gate in the second condition and wherein said start means is operable to move said latch from said second condition to said first condition, and wherein said output signal from said detector means is operable to cause said latch to move from the first to the second condition, pulse generating means connected to the latch of each counter stopping means to the latch of the counter stopping means for the timing counter means next in succession, said pulse generating means connected to issue a pulse when the first mentioned latch is moved from the first to the second condition to the start means input of the latch for the next in succession timing counter to cause said second latch to move from the second condition to the first condition.

8. A system for indicating the lapsed time in accordance with claim 1, and wherein said counter stopping means for each said timing counter includes a gate operable in a first condition to connect said clock to operate said timing counter means, and in a second condition to disconnect said clock therefrom, a bystable latch operable in a first condition to hold said gate in a first condition and operable in a second condition to hold said gate in the second condition and wherein said start means is operable to move said latch from said second condition to said first condition, and wherein said output signal from said detector means is operable to cause said latch to move from the first to the second condition, pulse generating means connected to the latch of each counter stopping means to the latch of the counter stopping means for the timing counter means next in succession, said pulse generating means connected to issue a pulse when the first mentioned latch is moved from the first to the second condition to the start means input of the latch for the next in succession timing counter to cause said second latch to move from the second condition to the first condition, said pulse having a time length which is longer than the interval of signals from said transmitting means occurring when said transmitting means is within the predetermined area of a said station and having a time interval shorter than the time interval required for an entity to move from one said station to another.

9. A system for indicating the lapsed time in accordance with claim 1, and wherein each said radio frequency receiving means comprises a conductive loop having two lengths spaced apart and traversing the path of movement of said entities at substantially right angles thereto, and said transmitting means being mounted on a card and having an inductance printed in a helix on said card, each of said cards being positioned with said helix being mounted on said contestant with said helix being in a position for satisfactory radiation traversing between said helix and said loop.

10. A system for indicating the lapsed time in accordance with claim 1, and wherein said start means is operable to start all of said timing counters when actuated.

11. A system for indicating the lapsed time in accordance with claim 1, having first and second start means, said first start means being operable upon actuation to start only the first of said timing counters in each of the series of timing counters and said second start means being operable to ostart the remaining of said counter means upon actuation, means responsive to the first actuation of a counter stopping means to operate said second start means.

12. A system for indicating the lapsed time in accordance with claim 1, and comprising counter means connected to the counter stopping means of each of the comparable timing counters of the respective serially connected counters and operable to count the order of succession of the entities past a given station and means to display indica of said order of succession.

13. A system for indicating the lapsed time in accordance with claim 1, and wherein said timing counter means comprise a digital time display mounted in a matrix of rows and columns in which one of said rows and columns includes the timing counters serially connected to a said detector means and one of said rows and columns includes the timing means in the respective serial group related to predetermined stations along said path of movement of said entities.

* * * * *